US011021216B2

(12) United States Patent
Oberlies et al.

(10) Patent No.: US 11,021,216 B2
(45) Date of Patent: Jun. 1, 2021

(54) MOORING LINE CORROSION BARRIER AND METHODS OF MANUFACTURE AND INSTALLATION

(71) Applicant: ExxonMobil Upstream Research Company, Spring, TX (US)

(72) Inventors: Robert R. Oberlies, Spring, TX (US); Sangsoo Ryu, Cypress, TX (US); Chia-Hao Ko, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 16/774,540

(22) Filed: Jan. 28, 2020

(65) Prior Publication Data

US 2020/0262519 A1 Aug. 20, 2020

Related U.S. Application Data

(60) Provisional application No. 62/808,085, filed on Feb. 20, 2019.

(51) Int. Cl.

| | |
|---|---|
| ***B63B 21/50*** | (2006.01) |
| ***B63B 21/08*** | (2006.01) |
| ***B63B 21/20*** | (2006.01) |

(52) U.S. Cl.

CPC ..... *B63B 21/50* (2013.01); *B63B 21/08* (2013.01); *B63B 21/20* (2013.01); *B63B 2021/203* (2013.01)

(58) Field of Classification Search

CPC ..... B63B 21/00; B63B 21/08; B63B 21/20; B63B 21/50; B63B 22/00; B63B 22/02; B63B 2021/203

USPC ..... 114/230.27; 441/3, 5, 23

See application file for complete search history.

(56) References Cited

U.S. PATENT DOCUMENTS

| | | | | |
|---|---|---|---|---|
| 3,101,491 | A * | 8/1963 | Salo | B63B 22/02 441/3 |
| 4,123,338 | A | 10/1978 | Wootten | |
| 4,285,615 | A | 8/1981 | Radd | |
| 4,756,267 | A | 7/1988 | Carr et al. | |
| 6,899,492 | B1 | 5/2005 | Srinivasan | |
| 7,188,579 | B2 | 3/2007 | Lemonides | |
| 8,978,532 | B2 | 3/2015 | Canedo Duarte da Rocha et al. | |

(Continued)

FOREIGN PATENT DOCUMENTS

WO 2014049034 A1 4/2014

OTHER PUBLICATIONS

Ma et al., "Life Extension of Mooring System for Benchamas Explorer FSO", Proceedings of the 19th Offshore Symposium, Texas Section of the Society of Naval Architects and Marine Engineers, Houston, Texas, p. 1-14, Feb. 2014.

*Primary Examiner* — Lars A Olson

(74) *Attorney, Agent, or Firm* — Leandro Arechederra, III

(57) ABSTRACT

Described herein are mooring systems for floating structures and methods for manufacturing and installing such mooring systems. The mooring system may comprise a line having a first end operatively connected to the floating structure and a second end operatively connected to an anchor underwater or to a seabed, wherein the line comprises at least two substantially rigid links joined together; and a watertight sheath surrounding the line and extending at least along a length of the line from a position below the waterline to a position above the waterline.

8 Claims, 4 Drawing Sheets

(56) References Cited

U.S. PATENT DOCUMENTS

2002/0177375 A1* 11/2002 Cottrell ..... B63B 22/021
441/5
2013/0152839 A1 6/2013 Graf

* cited by examiner

MOORING LINE CORROSION BARRIER AND METHODS OF MANUFACTURE AND INSTALLATION

CROSS-REFERENCE TO RELATED APPLICATION

This application claims the benefit of U.S. Provisional Patent Application 62/808,085 filed Feb. 20, 2019 entitled MOORING LINE CORROSION BARRIER AND METHODS OF MANUFACTURE AND INSTALLATION, the entirety of which is incorporated by reference herein.

FIELD OF THE INVENTION

Described herein are methods and systems for protecting a mooring line from corrosion, and methods and systems for manufacturing and installing such corrosion barriers on a mooring line.

BACKGROUND

In traditional offshore operations, the use of chains, wire ropes, or synthetic ropes for mooring lines is desirable. Mooring lines offer flexibility to the floating structure, allowing the structure to move in response to waves, winds, and currents. Mooring lines must be able to withstand large tensile loads, be compliant, and should have a relatively long fatigue life despite repeated cycles of stress and relaxation.

Mooring lines in marine environments can be susceptible to corrosion due to the reaction of the salt water and air with the metal in the mooring line. As described in U.S. Pat. No. 4,123,338, coatings, such as thermally sprayed aluminum coatings, have been applied to mooring lines in attempts to protect the mooring line from corrosion. However, existing sprayed coatings often have poor durability during transport and installation of the mooring line.

Additionally, corrosion rates for the location where the mooring line is to be used are often not well understood before the mooring line is installed. As such, it can be difficult to design and predict the corrosion allowance for a mooring line. If a mooring line experiences higher corrosion rates than anticipated (i.e., greater than the corrosion allowance), there are few means of remediation other than to change out the corroded portion of the mooring line.

Therefore, there remains a need for mooring lines having improved corrosion resistance. In particular, there remains a need for methods and systems that can be implemented at the time of the mooring line's manufacture as well as methods and systems that can be implemented after installation of the mooring line in the marine environment. It would also be desirable to have methods and systems that allow for maintenance and inspection of the mooring line.

Additional background references may include: U.S. Pat. Nos. 4,285,615 A, 4,756,267 A, 6,899,492 B1, 7,188,579 B2, and 8,978,532 B2; U.S. Patent Application Publication No. 2013/0152839 A1; PCT Publication No. WO 2014/049034; and Ma et al., "Life Extension of Mooring System for Benchamas Explorer FSO", Proceedings of the 19$^{th}$ Offshore Symposium, Texas Section of the Society of Naval Architects and Marine Engineers, Houston, Tex., p. 1-14, February 2014.

SUMMARY

Described herein are mooring systems for floating structures. The mooring system may comprise a line having a first end operatively connected to the floating structure and a second end operatively connected to an anchor underwater or to a seabed, wherein the line comprises at least two substantially rigid links joined together; and a watertight sheath surrounding the line and extending at least along a length of the line from a position below the waterline to a position above the waterline.

Also described herein are methods for installing a corrosion barrier around a mooring fine. For example, the method may comprise providing two or more substantially rigid links joined together, wherein the rigid links are hanging in a substantially vertical orientation; providing a sheath that comprises a hinged caisson and a hook to close the caisson; encircling the rigid links with the sheath and closing the caisson, wherein an annular space is formed between the sheath and the rigid links; sealing the bottom end of the sheath; and filling the annular space with a filler material. As another example, the method may provide for encasing at least a portion of a mooring line in a marine environment, and may comprise providing a floating structure in a marine environment; providing a mooring line, wherein the mooring line has a first end that is operatively connected to the floating structure and a second end that is operatively connected to an anchor under the waterline, wherein the mooring line comprises at least two substantially rigid links joined together; providing a corrosion barrier that comprises a hinged caisson and means for closing and sealing the caisson; encircling the rigid links with the caisson, wherein an annular space is formed between the caisson and the rigid links; sealing the bottom end of the corrosion barrier; and filling the annular space with a filler material.

In one or more embodiments, the methods described herein may be used to retrofit an existing mooring line. For example, the methods may comprise identifying a length of a mooring line that exhibits degradation; and encasing the length of the line that exhibits the degradation with the corrosion barriers described herein.

BRIEF DESCRIPTION OF THE DRAWINGS

Advantages of the present methodologies and techniques may become apparent upon reviewing the following detailed description and accompanying drawings.

DETAILED DESCRIPTION OF THE DISCLOSURE

Figure 1A:
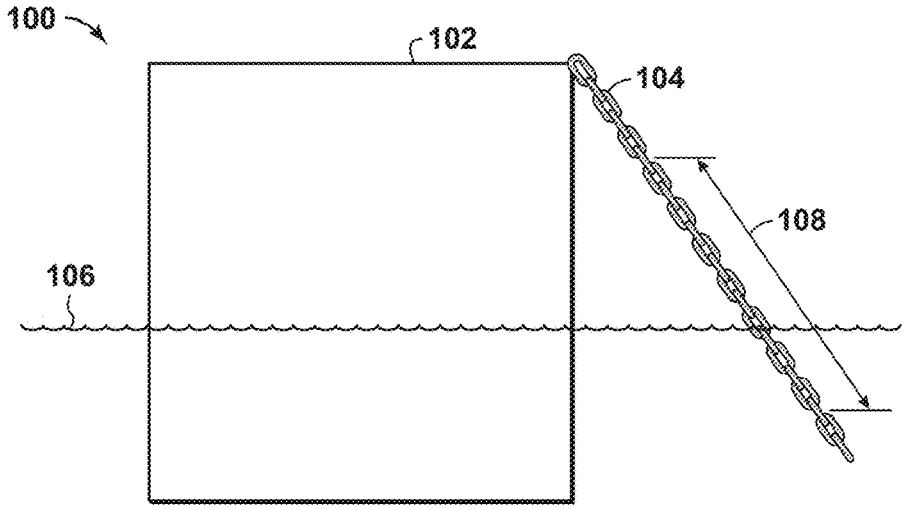
FIGS. 1A and 1B illustrate an example of a mooring chain connected to an offshore floating structure.

To the extent the following description is specific to a particular embodiment or a particular use, this is intended to be illustrative only and is not to be construed as limiting the scope of the invention. On the contrary, it is intended to cover all alternatives, modifications, and equivalents that may be included within the spirit and scope of the invention.

Example methods described herein may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement various embodiments of an example methodology. Blocks may be combined or separated into multiple components. Furthermore, additional and/or alternative methodologies can employ additional blocks not shown herein. While the figures illustrate various actions occurring serially, it is to be appreciated that various actions could occur in series, substantially in parallel, and/or at substantially different points in time.

Various terms as used herein are defined below. To the extent a term used in a claim is not defined below, it should be given the broadest possible definition persons in the pertinent art have given that term as reflected in at least one printed publication or issued patent.

The term "arctic" refers to any oceanographic region wherein ice features may form or traverse through.

The term "fluid" refers to gases, liquids, and combinations of gases and liquids. In some embodiments, the term "fluid" may also refer to combinations of gases and solids and/or combinations of liquids and solids.

The term "hydrocarbons" refers to molecules formed primarily of hydrogen and carbon atoms, such as oil and natural gas. Hydrocarbons may also include trace amounts of other elements or compounds, such as halogens, metallic elements, nitrogen, oxygen, sulfur, hydrogen sulfide ($H_2S$), and carbon dioxide ($CO_2$). Hydrocarbons may be produced from hydrocarbon reservoirs through wells penetrating a hydrocarbon containing formation. Hydrocarbons derived from a hydrocarbon reservoir may include, but are not limited to, petroleum, kerogen, bitumen, pyrobitumen, asphaltenes, tars, oils, natural gas, or combinations thereof. Hydrocarbons may be located within or adjacent to mineral matrices within the earth, termed reservoirs. Matrices may include, but are not limited to, sedimentary rock, sands, silicates, carbonates, diatoms, and other porous media.

The term "ice sheet" refers to a floating an moving mass of ice, floe ice, or ice field. The term also encompasses pressure ridges of ice within ice sheets.

The term "marine environment" refers to any offshore location. The offshore location may be in shallow waters or deep waters. The marine environment may be an ocean body, a bay, a large lake, an estuary, a sea, or a channel.

The term "mooring line" encompasses any line used in the marine field for the control of loads to which it is attached.

The term "platform" refers to a deck on which offshore operations, such as drilling operations, take place. The term may also encompass any connected supporting floating structure.

The term "seabed" refers to the floor of a marine body. The marine body may be an ocean or sea or any other body of water that experiences waves, winds, and/or currents.

The term "subsurface" refers to geological strata occurring below the earth's surface.

The present disclosure provides improved methods and systems for mooring offshore floating oil/gas production platforms or other marine vessels. Mooring lines used to moor offshore floating structures in marine environments can be susceptible to loss of strength (and ultimately failure) due to corrosion. The presently described methods and systems provide improved mooring systems that are designed to prevent or lessen corrosion formation on mooring lines. Further, the methods and systems described herein may be used to retro-fit existing mooring lines that have experienced corrosion degradation.

Figure 1B:
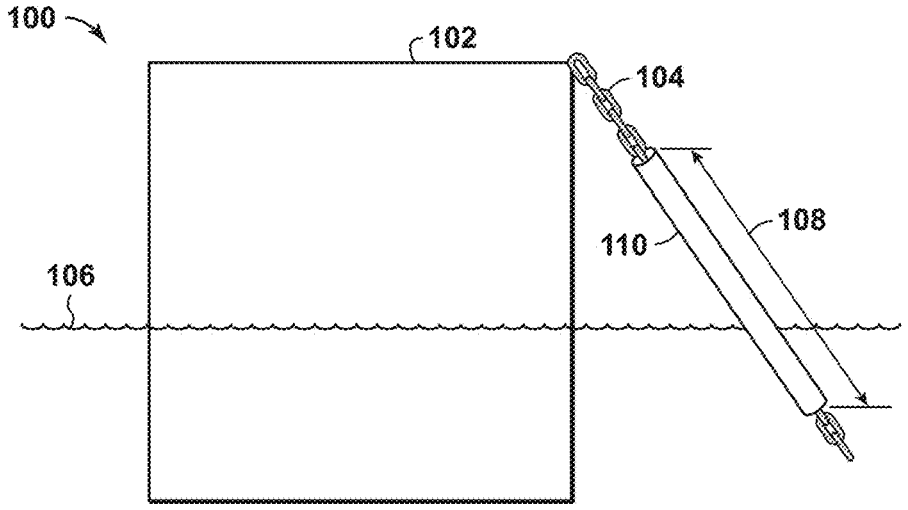

The area of a mooring chain that is likely to see the highest rates of corrosion are in the splash zone where water, air, and the metal material in the mooring line are in contact with one another. FIG. 1A presents an illustration 100 of a moored floating structure 102 floating in a marine environment. The floating structure may be any type of floating structure or vessel, such as an FPSO, FLNG, semi-submersible, SPAR, deep-draft caisson vessel, or any vessel that utilizes catenary anchored legged mooring. The floating structure 102 may be anchored to the seafloor by a mooring line 104. The waterline 106 of the marine environment intersects the moored floating structure 102 and the mooring line 104. As the waterline 106 moves up and down due to wind, waves, and current, the area of intersection of the mooring line 104 and the waterline 106 may be varied, and this area may be referred to as the splash zone 108. As seen in FIG. 1B a corrosion barrier 110 may be installed around the mooring line 104 to minimize and/or prevent contact between the mooring line 104 and the corrosive environment (i.e., the environment the comprises both air and water) in the splash zone 108. In one or more embodiments, the top surface of the corrosion barrier 110 may be angled, rounded, or domed to promote water run-off. For example, the top surface of the corrosion barrier may be slanted or be hemispherical in order to prevent rain water from pooling on the top surface.

Figure 2:
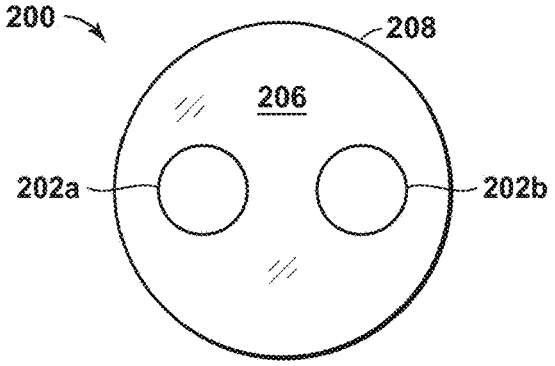
FIG. 2 is illustrates a cross-section of a mooring chain.

FIG. 2 illustrates a cross-section 200 of the mooring line and the corrosion barrier. As seen in FIG. 2, the links of the mooring line 202*a* and 202*b* are encapsulated with a corrosion barrier 208. The annular space 206 between the mooring line and the exterior 208 of the corrosion barrier can be filled with a filler material.

The mooring line may comprise a plurality of rigid links, such as chain links, and may be formed from a metal or metal alloy. For example, the mooring line may comprise metal chain links formed out of steel. The steel alloy may comprise one or more of aluminum, NB, vanadium, titanium, and/or molybdenum. In one or more embodiments, one or more of the plurality of rigid links may have a length that is greater than 24 inches, or greater than 30 inches, or greater than 32 inches, or greater than 34 inches. In one or more embodiments, one or more of the plurality of rigid links may have a diameter that is greater than 4 inches, or greater than 5 inches, or greater than 6 inches. In one or more embodiments, one or more of the rigid links may have a weight of greater than 100 kg/link, or greater than 150 kg/link, or greater than 200 kg/link.

The corrosion barrier may comprise a sheath. The sheath may extend along the splash zone of the mooring line. For example, the sheath may extend along the length of the mooring line where both water and air interface the mooring line. For example, in one or more embodiments, the sheath may extend along the length of the mooring line from the deck of the floating structure to a depth of at least 15 meters, or at least 30 meters, or at least 45 meters below the water line.

In one or more embodiments, a sheath surrounds the circumference of one or more of the rigid links that form the mooring line. In some embodiments, the sheath may directly abut the rigid links of the mooring line. The sheath is preferably fluid tight and prevents or minimizes the contact of water and air with the encapsulated rigid links. The sheath may be cylindrically shaped or may conform to the shape of the mooring line.

The sheath may be comprised of any suitable material. Preferably, the sheath is corrosion resistant, seawater resistant, and/or UV resistant. Preferably, the sheath is also temperature resistant and can withstand the varied temperatures experienced in a marine environment. For example, the watertight sheath may comprise a material that is resistant to degradation over a range of temperatures, such as from −10° C. to 40° C., or from 0° C. to 40° C., or from 0° C. to 30° C., or from 0° C. to 25° C., or from 0° C. to 20° C.

In one or more embodiments, the sheath may comprise a polymeric material, such as a polyolefin (such as polypropylene or polyethylene), rubber, epoxy, polyamide, polyester, polyurethane, ABS, polyvinyl, or polyether. The sheath may also comprise additives of one or more different materials that aid in UV resistance, seawater resistance, and/or temperature resistance.

In one or more embodiments (such as that shown in FIG. 2), a filler may be positioned between the sheath and the mooring line. The filler may be comprised of any suitable material and may be a solid or a liquid. For example, the filler may comprise a material that enters the sheath as a liquid and hardens over time, or may comprise a material that remains in a viscous liquid phase. For example, the filler may comprise an epoxy or an injection filler. For example, the filler may comprise a poly-dicylcopentadiene filler. In some embodiments, the filler may comprise a buoyant material, that is, the filler may comprise a material that has a density (and thus specific gravity) less than that of seawater.

Figure 3A:
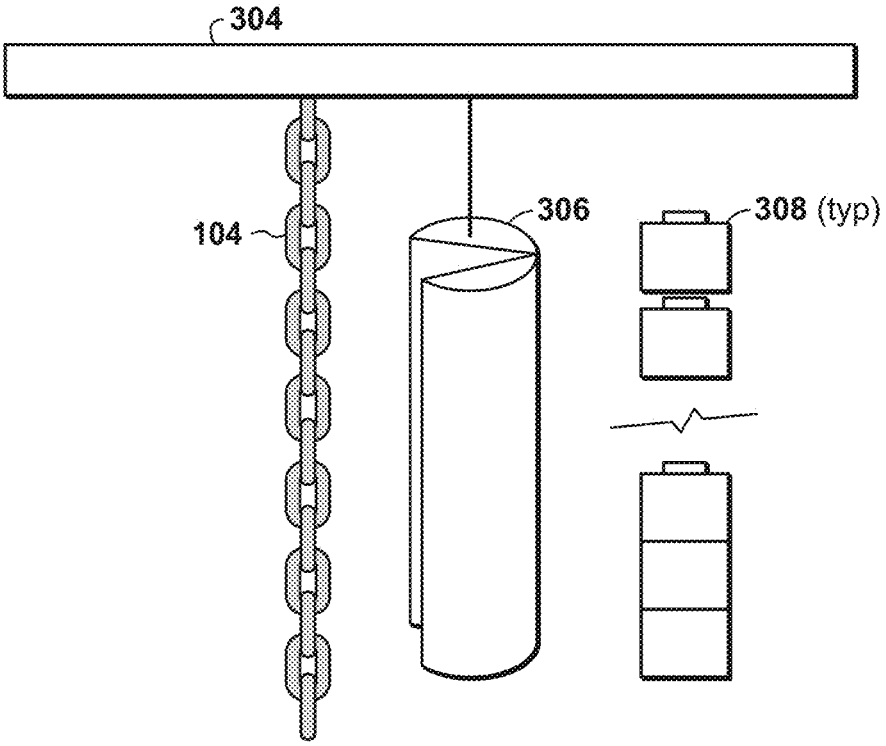
FIGS. 3A and 3B illustrate an exemplary method of installing a barrier around the mooring chain.

In one or more embodiments, the corrosion barriers described herein may be placed around the rigid links of the mooring line before the mooring line is placed in the marine environment. For example, the corrosion barrier may be installed around mooring line chain links in an on-shore fabrication yard. FIG. 3A illustrates an example of an on-shore installation. One or more chain links of a mooring line 104 may be hung from a supportive beam 304 or otherwise raised off of the ground. The corrosion barrier 306 may then be placed around the mooring line 104.

The corrosion barrier 306 may be comprised of two or more modular pieces 308. The use of modular pieces may provide for easier installation and handling of the corrosion barrier. Further, the use of modular pieces can allow for the corrosion barrier to be composed of different materials along the length of the mooring line. For example, the modular pieces that encircle the chain links that are intended to be predominately below the water line may be comprised of a first material (for example, a material that provides improved resistance to salinity) and the module pieces that encircle the chain links that are intended to be predominately above the water line may be comprised of a second material (for example, a material that provides improved UV resistance).

Figure 3B:
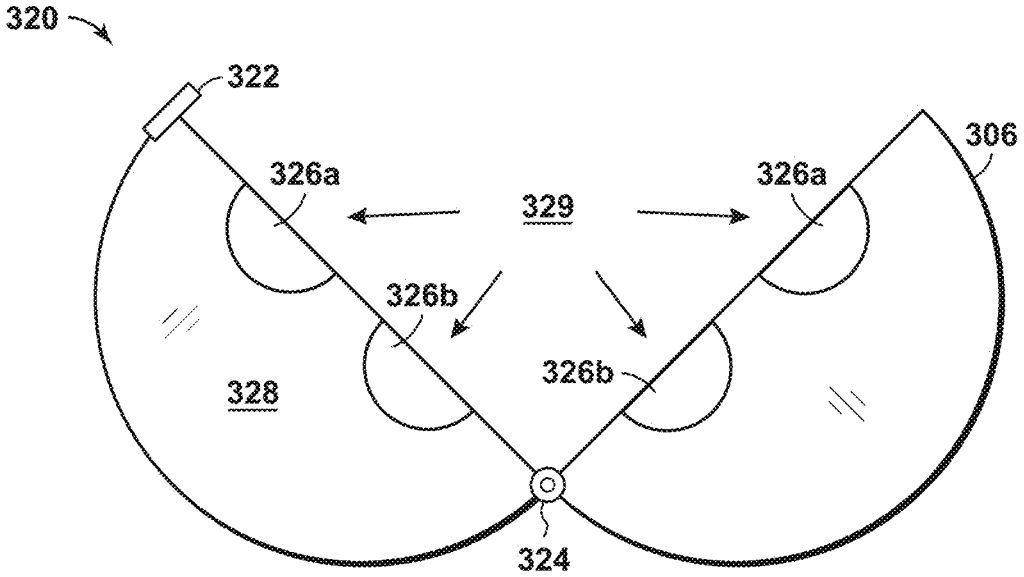

FIG. 3B illustrates a cross-section 320 of a corrosion barrier that comprises a hinged caisson. As seen in FIG. 3B, the corrosion barrier may be hinged to provide for ease of installation. The corrosion barrier 306 may have a hinge 324 that allows the corrosion barrier to open and close 329 around the mooring chain links 326*a* and 326*b*. The corrosion barrier may have a means 322 for closing or sealing the caisson 306. For example, the corrosion barrier may have a hook or clasp that allows the caisson to close.

Figure 4A:
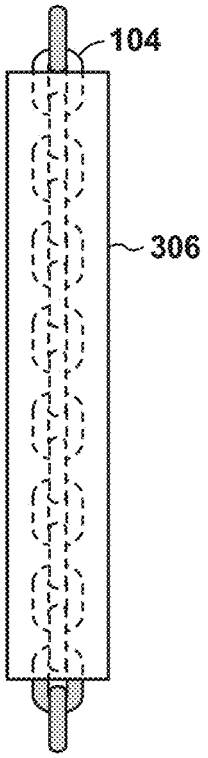
FIGS. 4A and 4B illustrate exemplary mooring chains with a single piece barrier in FIG. 4A and modular barriers in FIG. 4B.
Figure 4B:
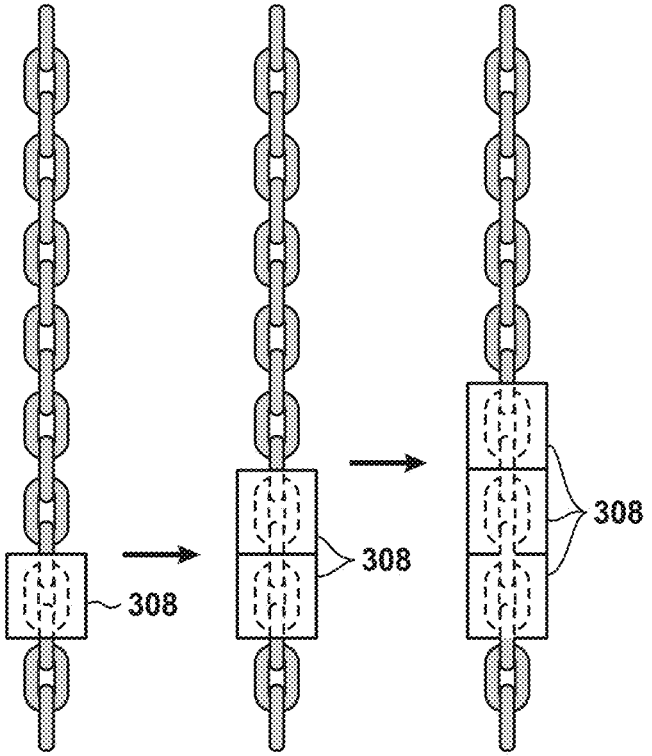

Thus, in one or more embodiments, the caisson may be opened and placed around hanging chain links to encircle the chain links of a mooring line 104. As seen in FIG. 4A, the corrosion barrier may comprise a single piece 306. Alternatively, as seen in FIG. 4B, the corrosion barrier may comprise modular pieces 308 that seal against one another. The modular pieces of the corrosion barrier may have telescoping connections that allow for filler to connect and/or flow between the modules.

Figure 4C:
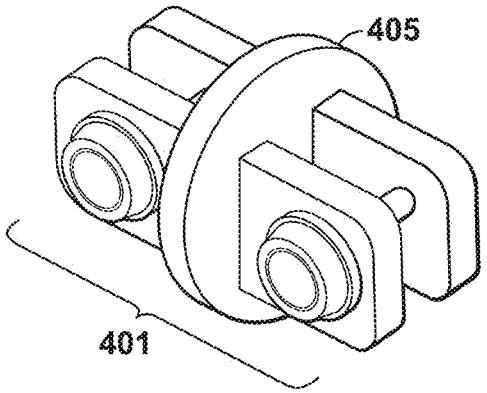
FIG. 4C illustrates an H-connector with a cylindrical cross-section.

The bottom end of the corrosion barrier may be sealed, for example a chain link 401 with a circular center member 405 as seen in FIG. 4C or with a gasketed clamped connection. After the bottom end of the corrosion barrier is sealed, the annular space between the corrosion barrier and the chain links may be filled with filler 328 (as seen in FIG. 3B). The seal at the bottom of the corrosion barrier may be a temporary seal or a removable seal. That is, the seal may be used while the filler is being put into place (and hardening) and then removed after the filler has fully filled-in the annular space between the sheath and the rigid links.

In one or more embodiments, the filler may be comprise a first part that is pre-engineered to fit around the rigid links. This first part of the filler may be pre-fabricated to take up the majority of the annular space that is formed between the sheath and the rigid links. The first part of the filler may be placed around the rigid links and the caisson may be closed around the first part of the filler and the links. Then, a second part of the filler may be used to fill in the remaining annular space.

In one or more embodiments, the sheath may be removed after the filler has hardened around the rigid links. For example, the sheath may be re-usable and may be removed after installation, leaving behind the hardened filler around the chain length.

Figure 5:
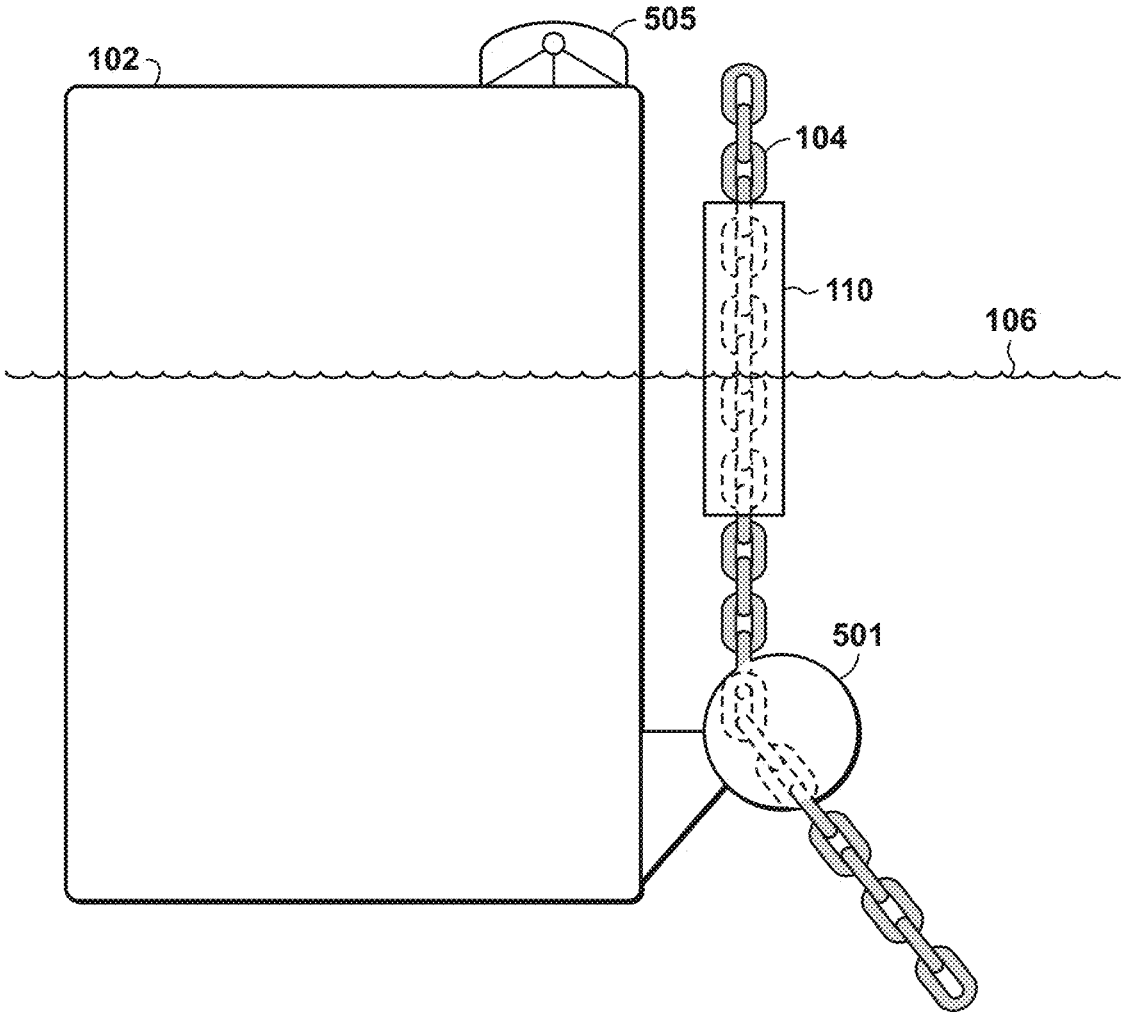
FIG. 5 illustrates an exemplary method of installing a barrier around an in-situ mooring chain.

In one or more embodiments, the corrosion barriers described herein may be placed around the rigid links of the mooring line after the mooring line has been placed in the marine environment. For example, the corrosion barrier 110 may be installed around the mooring line 104 after the mooring line has been installed on the floating structure 102. For example, as seen in FIG. 5, the mooring line may be raised and pulled through a fairlead 501 and into a chain-stopper 505 to locate the corrosion barrier 110 in the vicinity of the waterline 106. The corrosion barrier may then be installed around the portion of the mooring line that is in the splash line as described with reference to FIGS. 3-4. For example, the corrosion barrier may comprises a hinged caisson sheath that is closed to encircle around the mooring line. The bottom end of the corrosion barrier may be sealed and filler may be placed into the annular space between the corrosion barrier and the rigid links.

In one or more embodiments, the caisson or sheath of the corrosion barrier may have a port that allows for injecting filler material into the annular space between the sheath and the rigid links. The filler material may then be injected into the annular space under pressure, thus, causing any water in the annular space to be pushed out of the caisson. The corrosion barrier may also have a check valve to allow for air to escape from the annular space.

In one or more embodiments, remotely operated vehicles may be used to aid in the installation of the corrosion barrier in in situ marine environments. Further, in one or more embodiments, pumps may be used to remove water from the annular space between the sheath and the rigid links before the filler is installed.

The ability to install the corrosion barrier in situ in the marine environment, provides for the ability to retrofit existing mooring lines. For example, a mooring line may have experienced more corrosion than anticipated due to unanticipated environmental conditions. The corrosion barriers described herein can then be used to retrofit such mooring lines to extend the life of the mooring line.

Thus, in one or more embodiments, the rigid links of a mooring chain may be inspected for signs of degradation. The inspection may be performed by visual inspection or by other testing means. For example, the chain link diameter may be measured periodically over time to determine changes (i.e., reductions) in the chain length diameter. For example, the chain links may be inspected by CT scan or other testing means. Once one or more chain links in the splash zone of the mooring line are identified as exhibiting degradation or more degradation than models would have expected, the chain links may be retro-fitted to be encapsulated by the corrosion barriers described herein.

The methods and systems described herein, may also have the benefit of allowing for ease of maintenance and inspection after the corrosion barrier has been installed. For example, the sheath and filler materials may be chosen to be see-through to allow visual inspection of chain integrity. As another example, the cylindrical shape of the corrosion barrier can allow for the leveraging of pipeline inspection tools to inspect and monitor the mooring chain. Additionally, the chain links and/or corrosion barrier can be inspected or monitored by CT scan, long-wavelength acoustic methods that are capable of piercing the filler material (e.g., by utilizing acoustic resonance techniques).

It should be understood that that preceding is merely a detailed description of specific embodiments of the invention and that numerous changes, modifications, and alternatives to the disclosed embodiments can be made in accordance with the disclosure herein without departing from the scope of the invention. The preceding description therefore, is not meant to limit the scope of the invention. Rather, the scope of the invention is to be determined only by the appended claims and their equivalents. It is also contemplated that structures and features embodied in the present embodiments can be altered, rearranged, substituted, deleted, duplicated, combined, or added to each other.

The invention claimed is:

1. A method for encasing at least a portion of a mooring line in a marine environment comprising:

(a) providing a floating structure in a marine environment;

(b) providing a mooring line, wherein the mooring line has a first end that is operatively connected to the floating structure and a second end that is operatively connected to an anchor under a waterline, wherein the mooring line comprises at least two substantially rigid links joined together;

(c) providing a corrosion barrier that comprises a hinged caisson and means for closing and sealing the caisson;

(d) encircling the rigid links with the caisson, wherein an annular space is formed between the caisson and the rigid links;

(e) sealing the bottom end of the corrosion barrier;

(f) filling the annular space with a filler material.

2. The method of claim 1, wherein the bottom end of the corrosion barrier is sealed with a chain link with a circular center member or a gasketed clamped connection.

3. The method of claim 1, wherein the corrosion barrier comprises a port for injecting the filler material into the annular space.

4. The method of claim 3, wherein the filler material is injected into the annular space under pressure and wherein the injection of the filler material causes any water between caisson and the rigid links to pushed out of the caisson.

5. The method of claim 1, wherein:

after step (b) and prior to step (c) identifying a length of the mooring line that exhibits degradation; and step (d) comprises encasing the rigid links within the length of the mooring line that exhibits the degradation with the caisson.

6. The method of claim 5, wherein the degradation is identified by visual inspection.

7. The method of claim 5, wherein the degradation is identified by measurement of the diameter of the chain link.

8. The method of claim 5, wherein the caisson is used to further encase a length of the line that is likely to exhibit degradation wherein the likeliness is identified by modeling or past experience.

* * * * *